United States Patent [19]

Ban et al.

[11] 4,193,862

[45] Mar. 18, 1980

[54] RECOVERY OF OIL AND GAS FROM OIL SHALE

[75] Inventors: Thomas E. Ban, South Euclid; William H. Marlowe, Euclid, both of Ohio

[73] Assignee: McDowell-Wellman Company, Cleveland, Ohio

[21] Appl. No.: 919,081

[22] Filed: Jun. 26, 1978

[51] Int. Cl.[2] ..... C10G 1/02

[52] U.S. Cl. ..... 208/11 R; 48/197 R

[58] Field of Search ..... 208/11 R

[56] References Cited

U.S. PATENT DOCUMENTS

| | | | |
|---|---|---|---|
| 3,325,395 | 6/1967 | Ban | 208/11 R |
| 3,560,368 | 2/1971 | Rowland et al. | 208/11 R |
| 3,703,052 | 11/1972 | Linden | 208/11 R |

*Primary Examiner*—Herbert Levine

*Attorney, Agent, or Firm*—Pearne, Gordon, Sessions

[57] ABSTRACT

A method of educting oil from fine, high carbon oil shales is disclosed. The method includes the steps of providing a burden of oil bearing shale having a high fixed carbon content and charging the shale in the traveling grate machine, preferably a circular traveling grate machine. The burden is moved in a horizontal plane into a retorting zone, where the shale is heated to an oil-educating temperature of at least 800 degrees F. Oil and a medium BTU gas is educted from the burden, and the burden is then moved to a gasifying zone, where steam and air are downdrafted through the burden to raise the temperature of the burden to a temperature in excess of 1800 degrees F. Such a temperature converts substantial amounts of residual carbon in the burden to carbonaceous gases, and promotes substantial agglomeration or clinkering of the spent shale to enable a separation recyling process. The spent shale is cooled and the spent agglomerated shale is discharged from the machine.

16 Claims, 3 Drawing Figures

INERT GAS SEALS
MEDIUM Btu GAS
COARSE CLINKERED SHALE
RECYCLE PELLETS
OIL SHALE -2"+1/4"
OIL SHALE -1/4"
RETURNS -1/4"
STEAM-AIR
COOLING
RETORTING
GASIFYING
LOW Btu GAS
OIL
BALL MILLING
BALLING
-8"+2"
-2"+1/4"
-1/4"
10
12
14
16
18
20
22
24
26
28
42
44
46
48
50
52
54
56
58
60
62
64
66
68
70

RECOVERY OF OIL AND GAS FROM OIL SHALE

BACKGROUND OF THE INVENTION

Oil shales of the United States are characterized as sedimentary rocks which contain a dispersed, organic constituent known as kerogen. In some cases, other organic materials, such as coal and bitumen, can be interspersed with kerogen in the shale, contributing to a complex organic content. The Western oil shales of the United States, in Colorado, Utah, and Wyoming, are frequently known as the Eocene shales of the Green River formation. Oil shales of the eastern United States, principally in Indiana, Tennessee, Kentucky, and Ohio, are frequently referred to as Devonian, Mississippian, and Ordovician shales, which refer to their period or era of deposition. The Eastern shales originate principally in formations referred to as Chattanooga shale, New Albany shale, Antrim shale, and Appalachian shale.

Retorting of the various qualities of shale causes pyrolytic decomposition of the organic matter, which degrades into fixed carbon, noncondensable-combustible gases, and condensable oils referred to as crude shale oil. Standard analytical methods of determining oil assays of oil shales involve Fisher retorting tests, which provide preliminary data concerning oil and gas yields. Analysis of spent shale provides analytical information with respect to residual fixed carbon in retorted shales.

The western Colorado shales have a high yield of oil from pyrolytic decomposition (retorting) of the contained organic matter. Generally, 65 to 85 percent of the organics (principally carbon and hydrogen as hydrocarbon) in Western shales convert to oil and gases and the residual organic matter converts to fixed carbon within the spent shale. It is common to have Western shales containing about 12 to 15 percent organics to yield about 30 gallons of oil per ton of shale and have 2 to 4 percent carbon residual in the spent shale, which indicates a relatively high yield for the recovery of organics as oil.

The Eastern shales, on the other hand, can have a comparable content of organics in the raw shale, but when they are retorted, they have lower yields of oil and gas, and have a relatively high content of fixed carbon residuals in the shale. This factor is especially prominent when the eastern shales contain coal and other carboniferous matter with the kerogen. An example of retorting Eastern shales containing approximately 12 to 13 percent organics shows an oil yield of about 10 gallons of oil per ton of shale, with only about 30 percent of the organics converted into oil. Consequently, spent shales have a fixed carbon content on the order of 6 to 10 percent.

The reasons for the varying oil yields from the organics are not precisely known. In some cases, the carbon:hydrogen ratios of the original organics can be used as guides concerning oil yields. For instance, Western oil shales have a carbon:hydrogen ratio on the order of 6.5 to 7.5, whereas, the Eastern shales have a carbon:hydrogen ratio range from about 6.8 to 11.0. Normal coal, for instance, has a carbon:hydrogen ratio of 10. When coal is retorted, very high percentages of fixed carbon-coke residue are evident.

SUMMARY OF THE INVENTION

This invention provides a technique for increasing the yield of organics from Eastern oil shales, and particularly those shales having high quantities of coal dispersed therein. The technique is basically a two-step process involving retorting and gasification to evolve the fixed carbon as a low BTU gas.

Eastern oil shales may be classified in two categories as follows:

(1) relatively hard shale materials, which when crushed yield minimum quantities of fines, i.e., $-\frac{1}{8}$ inch material, and (2) soft shales, which when crushed create an abundance of $-\frac{1}{8}$ inch material.

Refuse from coal beneficiation processes are ordinarily oil shales which contain small amounts of coal and which are in the category of item (2), i.e., the softer shales.

Pelletizing processes are generally included in the preparation of materials for retorting when there is an abundance of $-\frac{1}{8}$ inch materials, as characterized by the softer shales. The preparation for pelletizing generally involves grinding the $-\frac{1}{8}$ inch fractions to approximately $-65$ mesh, followed by a balling operation which produces discrete, close-sized, green pellets as a charge or a partial of the charge for retorting.

Preferably, the retorting operation is carried out by a traveling grate machine in the manner set forth in U.S. Pat. Nos. 3,302,936; 3,325,395; and 4,013,517, the disclosures of which are incorporated herein by reference.

Abundant quantities of low BTU gas are produced as an intermediate operation between the retorting and cooling phases as a means for recovering gas from the high quantities of fixed carbon inherent in the retorting operations carried out on Eastern oil shale. The low BTU gas is produced by inducing an oxidizing draft media comprised of $O_2$, $CO_2$, and $H_2O$ vapor in varying percentage, as acquired from either specifically prepared gases or an air-steam flue gas blend.

Through control of the gasification cycle, the residue of shale can be enlarged to an agglomerate of centered clusters which are relatively massive and hardened, and which are severely depleted in carbon. The gasification step involves both exothermic and endothermic reactions. When the exothermic reactions are prominent, excessive heat is transferred to shale residue, which causes a partial fusion and sintering (agglomeration). Examples of exothermic reactions are carbon reacting with oxygen to produce $CO_2$ and CO, whereas examples of endothermic reactions are $CO_2$ and water vapor reacting with carbon to respectively produce CO and a mixture of CO plus hydrogen. After gasification, it has been noted that the highly clustered masses are depleted of carbon, whereas, those that are only partially depleted of carbon are largely small-sized, heat-hardened structures which are free-flowing and rubble-like in character. When a blend of gasified residue is cooled, it can be crushed through a breaker, where it is broken to approximately $-8$ inches. When this material is screened on a two-inch aperture, the $-8$ inch $+2$-inch clinkered residue is depleted in carbon and practically 90 percent of the fuel is removed. The $-2$ inch fractions, however, contain some clinker fragments and are largely spent shale which did not completely gasify, and therefore can be a useful recycle material for recovery of carbon on a subsequent retorting gasification path. The $-2$ inch fractions can optionally be recycled to the layer of the traveling grate bed, the top layer of the charge, or the charge layer of green pellets.

The gasification step is most adequately performed in deep bed layers, i.e., those generally exceeding 11 inches, and less than about 50 inches. To acquire such a burden on a traveling grate requires stages of green pellet applications, wherein about 11-inch layers of balls are dried before a subsequent layer is applied. Attempts to dry layers which are too deep cause partial condensation in lower portions of the bed, and sogging of the green pellets to a coalesced mass. Multilayers of green pellets can also be incorporated with the use of blends or stratified, recycled raw materials, such as partially gasified and hardened pellets and rubble-structured spent shale, usually $-2$ inches$+\frac{1}{4}$ inch in size.

When green pellets are charged to a traveling grate, they are relatively fragile, and it is difficult to maintain a uniform depth without piling the charge in front of the strike-off gate, which levels the burden. Such leveling of the strike-off gate causes breakage and degradation of the green pellets. When the green pellets are fed to the traveling grate, an uneven, undulating bed profile is frequently caused by surges of feeding which are not synchronized with traveling grate movement. This can be leveled by use of a top layer partial of recycle material or rubble-sized shale as applied on top of the undulating surface, and this is ultimately struck off to a level bed by a strike-off grate without damage to the green pellet structure. This provides a gas seal on the traveling grate for inhibiting gas flow from the hood to the atmosphere.

DETAILED DESCRIPTION OF THE INVENTION

Figure 1:
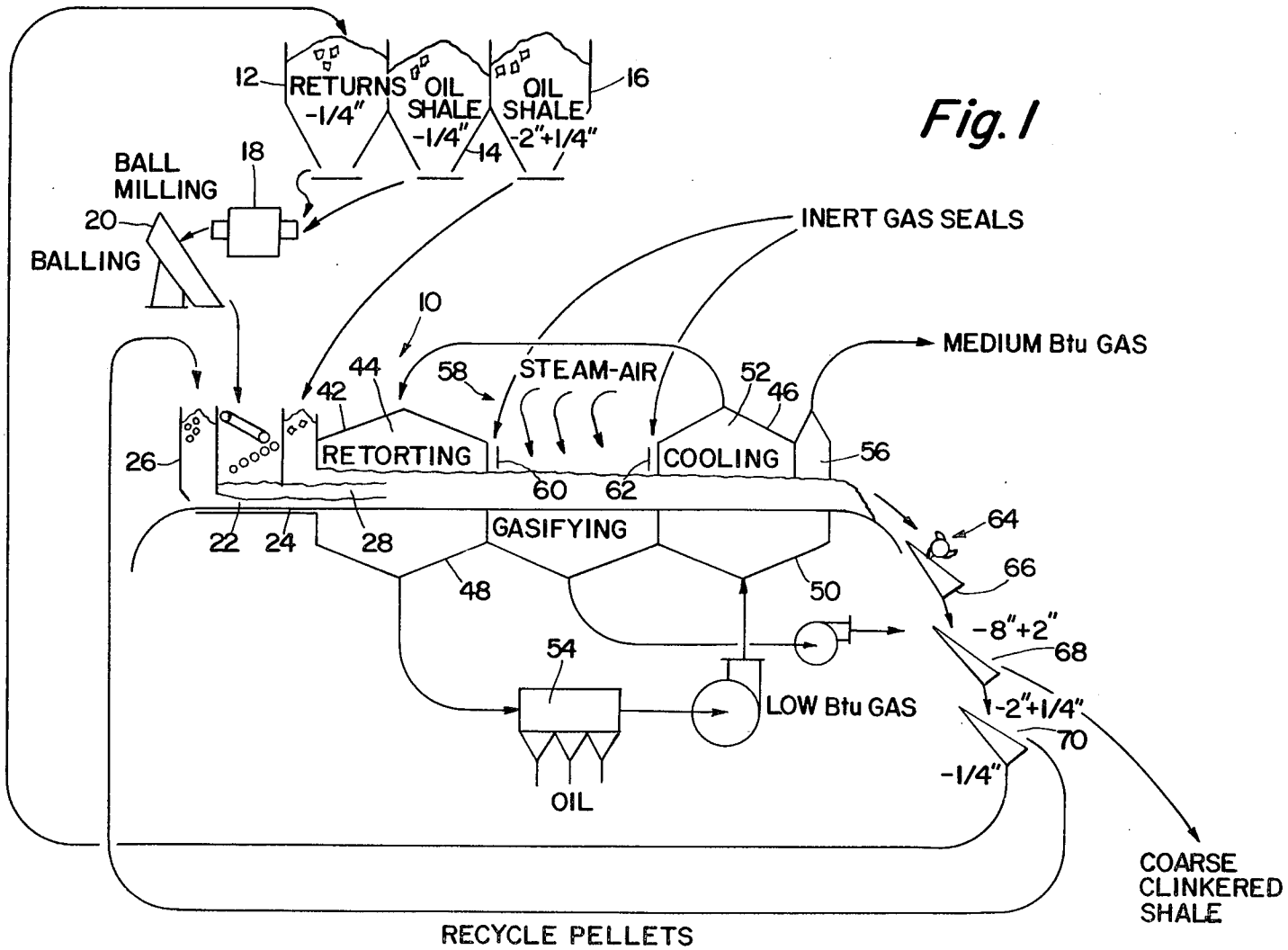
FIG. 1 is a diagrammatic illustration of a traveling grate apparatus equipped for performing the basic process.

Referring now to FIG. 1, there is illustrated the complete process for sequentially retorting oil shale, gasifying the spent carbon, and cooling the spent, gasified shale while recuperating heat. There is illustrated a traveling grate 10, which is preferably a circular traveling grate of the type illustrated in U.S. Pat. No. 4,013,417. The traveling grate 10 has a series of bins 12, 14, and 16, which respectively contain high-carbon $-\frac{1}{4}$-inch returns, $-2$-inch$+\frac{1}{4}$-inch shale. The returns and shale are used as the primary feed to the traveling grate. The $-\frac{1}{4}$ inch returns and $-\frac{1}{4}$-inch oil shale are fed to a ball mill 18 for fine grinding to about $-65$ mesh, and this material is balled in a balling machine 20 to about $-1$ inch$+\frac{1}{4}$-inch green pellets, with moisture additions. At this point, balling reagents and sulfur fixing reagents, such as bentonite and ground limestone, respectively, can be incorporated in the blend. A hearth layer 22 of $-2$ inch$+\frac{1}{4}$-inch recycle material is fed to the traveling grate 24 through a hopper 26. The hearth layer has a high-carbon content. The hearth layer is generally charged in a thickness which may vary from about 1 inch to about 18 inches in depth. The hearth layer is followed by a layer 28 of green pellets which has a depth of about 12 inches.

Figure 3:
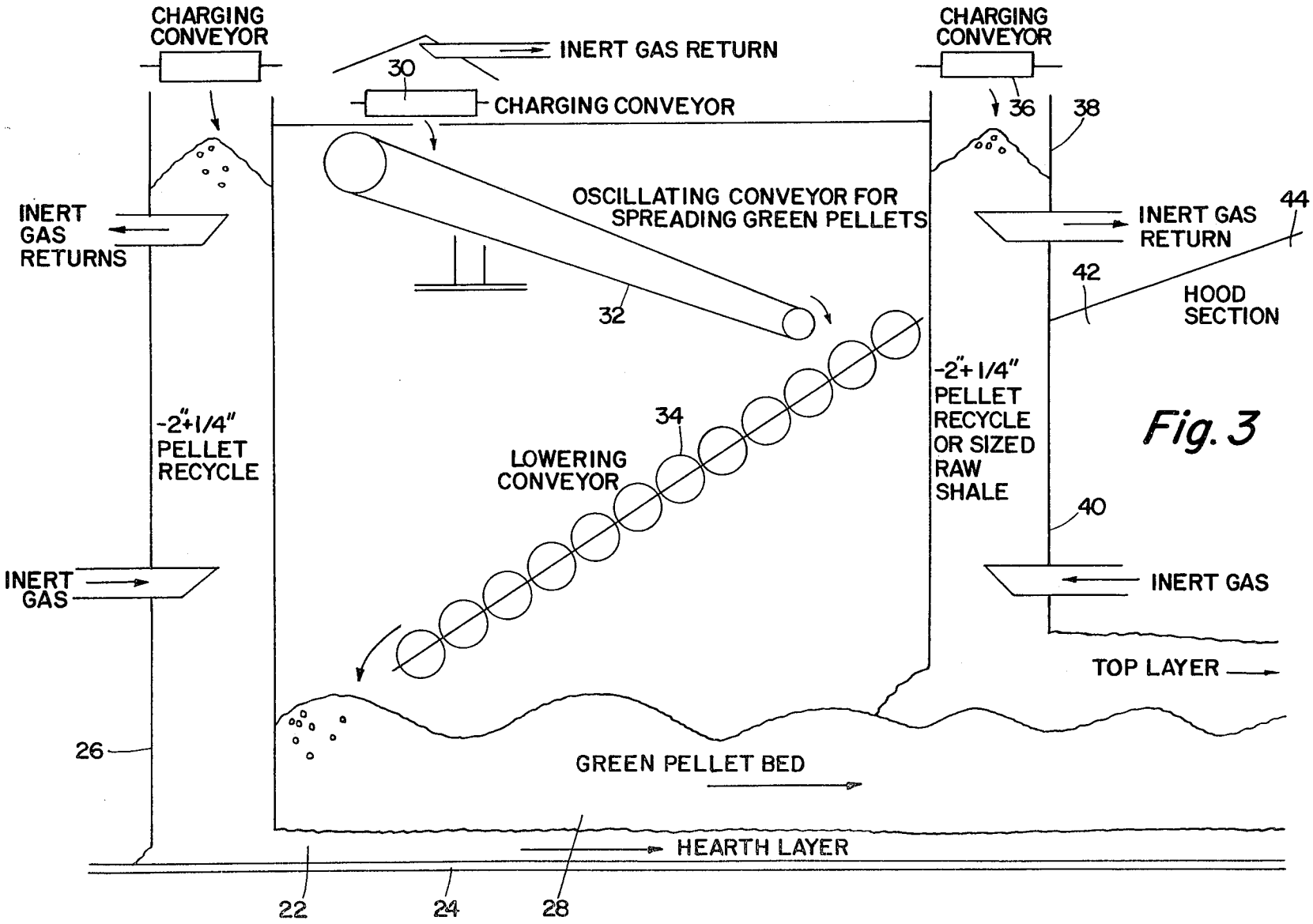
FIG. 3 is a diagrammatic illustration of a portion of the traveling grate illustrated in FIG. 1 and showing the charging operation in greater detail.

FIG. 3 illustrates the technique for lowering the green pellets to the hearth layer of the traveling grate. The green pellets are fed from a charging conveyor 30 to an oscillating conveyor 32 which applies the charge across a roller feeder 34, which lowers the green pellet charge to the traveling grate. Due to variations in the feed rate of the pellets, the pellets tend to form a wavy pattern on the hearth layer. However, a top layer of $-2$-inch$+\frac{1}{4}$-inch shale is delivered from a charging conveyor 36 to a feed hopper 38 to cover the green pellet bed and this top layer is struck off as an even length of charge by a hopper wall 40 to control the permeability of the bed and prevent gas leakage from the hood section 42 of a retorting zone 44 to the pellet charging areas. The hoppers 26 and 38 are purged with inert gas to allow the coarse rubble-structured material to be charged to the grate with minimum draft. Inert gas is applied near the lower layers of charge and ascends upwards to be recovered as inert gas returns. Upset pressure control within the hoods of the traveling grate machine would thereby infilter inert gas rather than air for maintaining process control within the gas-containing hoods 42 and 46 and windboxes 48 and 50 of the machine.

As the charge enters the retorting zone 44, a hot wave of recycled gases recirculated from a cooling zone 52 (FIG. 1) causes pyrolytic decomposition of the organic matter. In the retorting zone, the oil-shale should be heated to temperatures above 800 degrees F. to cause such decomposition. Condensable shale-oil is removed by liquid gas separation, such as by an electrostatic separator 54, and the relatively cool and low BTU gas is recycled to the cooling zone 52 to cool the spent shale. The recuperated heat superheats the gas for recycling to the retorting zone at a temperature ranging from about 900 degrees F. to 1500 degrees F. The medium BTU gas contains approximately 80% combustibles and is vented from a terminal cooling zone 56.

Between the retorting zone 44 and the cooling zone 52, there is provided a gasification zone 58. In the gasification zone, an air-steam blend is allowed to react with the hot residual carbon in the retorted shale. To prevent the steam and air from entering the retorting or cooling zones, inert gas seals 60 and 62 are provided. The draft media can be made from blends of $H_2O$, $CO_2$, and $O_2$ or flue gas-air blends or steam. During gasification, it is important to acquire bed temperatures in excess of 1800 degrees F., and preferably around 2300 degrees F. These high temperatures cause (1) thorough interraction and conversion of the residual carbon with the draft media to bring about gasification, and (2) thorough agglomeration or clinkering of the spent shale to enable a separation-recycling process. Gasification is brought about by the exothermal reactions, such as $C+O_2 \rightarrow CO$ and endothermal reactions, such as $C+H_2O \rightarrow H_2+CO$. Control of the quantity of exothermal reactions enables the bed temperatures to be controlled to a reasonable extent, i.e., use of about 5 to 15% $H_2O$ in an air blast on the hot pellets enables a considerable portion of the bed to clinker and react at a higher rate. Use of twice this amount of $H_2O$ diminishes the rate and extent of clinkering.

It is important to limit the length of the gasification zone along the machine because the firing zone propagates downward with the induced draft and a shallow lower layer of unreacted charge prevents reducing reactions to take place, i.e., oxidizing reactions of $C+O_2 \rightarrow CO_2$ proceed in the initial upper layers, and these are followed by reducing reactions $CO_2+C \rightarrow 2CO$ within the lower layers. As the firing zone penetrates the fixed shallow bed, excessive $CO_2$ is formed.

A bed which has been gasified by this process generally has about 1 inch of unclinkered pellets near the surface, a thick layer of clinkered material below the unclinkered pellets, and an unconsolidated layer of about 6 inches of unreacted pellets below the clinker. The lower layer of pellets has a high carbon content and can be adequately utilized by the recycling operation. Upon discharging, the clinker layer is broken by a clinker breaker 64 which forces all material through a grizzly 66 with 8-inch apertures. Two subsequent stages 68 and 70 of screening allow the following product separations:

(1) a −8-inch+2 inch carbon-depleted clinker [from the use of −2-inch shale];

(2) a −2-inch+¼-inch high-carbon, ungasified pellets and recycle shale of an unconsolidated nature which can be gasified by recycling; and (3) a −¼-inch, high-carbon recycle fine which can be recycled to the balling operation.

Figure 2:
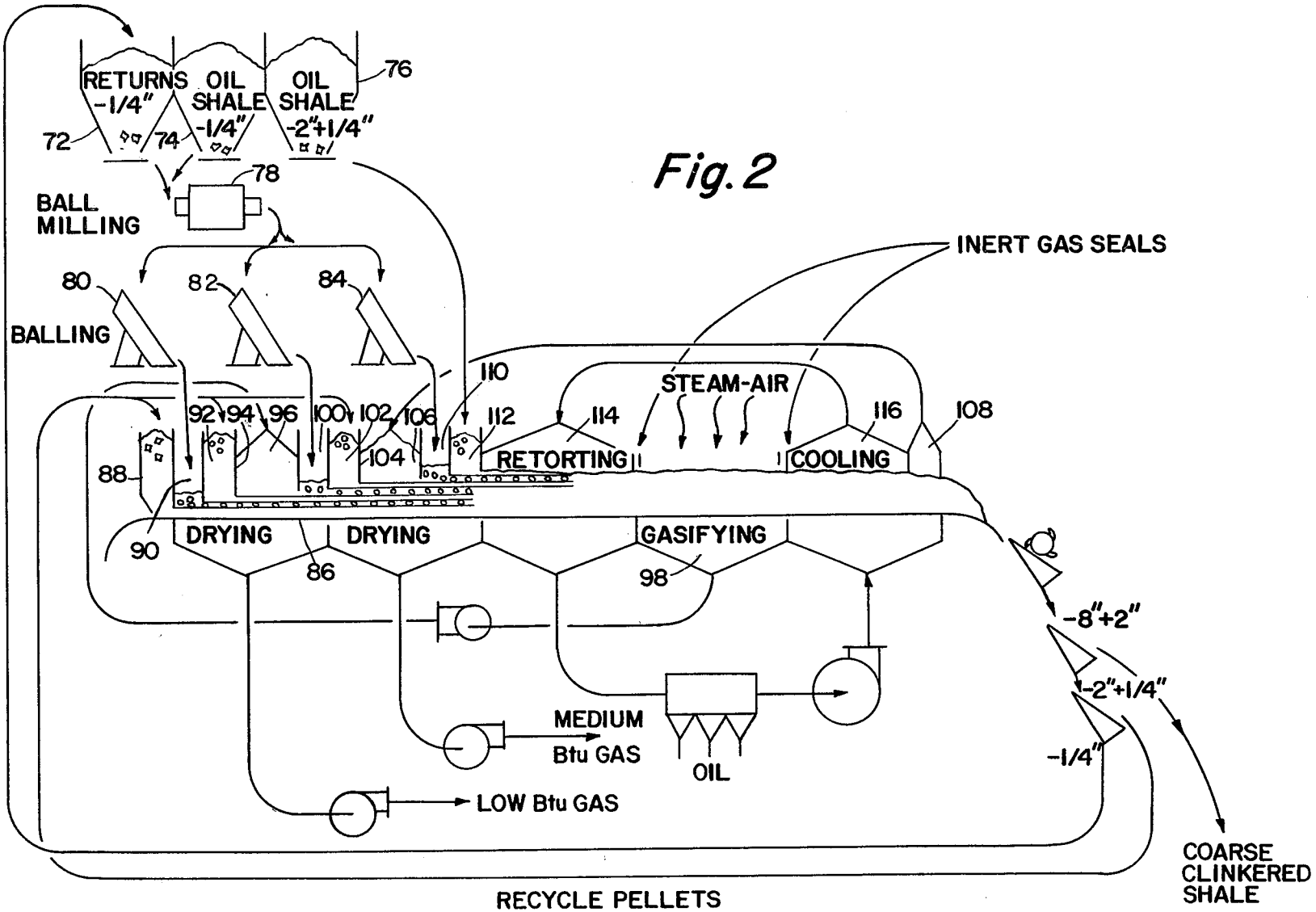
FIG. 2 is a diagrammatic illustration of a traveling grate apparatus according to another aspect of this invention and illustrating an operation wherein green pellets are layered and dried in the traveling grate prior to retorting.

Referring now to FIG. 2, there is illustrated an aspect of the present invention which enables deep beds of pellets to be applied by using intermittent drying stages of green pellet applications. Generally, if beds of green pellets deeper than 12 inches are dried by downdraft operations, the lower layer can be sogged and coalesced from condensation of evolved moisture. Through the illustrated stage drying operations, however, deep beds of pellets can be applied to enhance the reduction reactions of gasification. Recycled warm, low BTU gas and medium BTU gas can be used as a drying medium, as indicated.

In FIG. 2, a series of bins 72, 74, and 76 respectively contain high-carbon −¼-inch returns, −¼-inch shale, and −2-inch+¼-inch shale as the primary feed. The −¼-inch portions are fed to a ball mill 78 for fine grinding to −65 mesh, and this material is fed to three balling machines 80, 82, and 84, where the material is balled to about −1-inch+¼-inch green pellets, with moisture additions.

A hearth layer of −2-inch+¼-inch recycle material, with a high-carbon content, is applied directly to a traveling grate 86 through a bin 88. Pellets formed by the balling machine 80 are fed to a bin 90 and are layered onto the hearth layer at a depth of about 12 inches. Recycled −2-inch+¼-inch material is applied to the first layer of green pellets through a bin 92, and is struck off by a wall 94 of the bin. The thus-far deposited material passes through a hood 96, where the green pellets are dried by low BTU gas from a gasifying zone 98. Green pellets from the balling machine 84 are deposited onto the layered material through a bin 100. A further layer of −2-inch+¼-inch recycle material is deposited on the green pellets through a bin 102 and the recycle material is struck off by a wall 104 in the bin 102. The thus-far layered material is subjected to a further drying operation under a hood 106, with medium BTU gas vented from the terminal cooling zone 108. A further layer of green pellets is deposited in a bin 110 from the balling machine 84 and a final top layer of −2-inch+¼-inch coarse shale or, optionally, −2-inch+¼-inch recycle material is applied as a seal of charge on the previously layered material. This is applied in a choke-loaded column 112 directly on the green pellets.

The thus-layered material is successively conveyed to a retorting zone 114, the gasifying zone 98, and then to the cooling zone 116, where the layered material is treated in the manner previously described with reference to FIG. 1.

The following tables set forth data pertaining to the technique according to this invention, and pertinent test results.

TABLE I

TECHNIQUES FOR RETORTING AND GASIFICATION OF OIL SHALE FINES

| | | |
|---|---|---|
| Size Analysis | | |
| Oil shale | | −200 mesh |
| Composition of Blend | | |
| Oil shale | | 99% |
| Bentonite | | 1% |
| Size of Green Pellet | | −5/8" + 1/2" |
| Moisture Content | | 15% |
| Bed Depth | | 36.0 in. |
| Circular Grate | | |
| Simulation Techniques | | |
| (a) Method | | Circular grate |
| (b) Retorting cycle | | |
| | Depth | 12 in. |
| Drying - | Time | 15 min. |
| 1st layer | Temperature | 400 degrees F. |
| | Draft rate | 130 SCFM/FT$^2$ |
| | Depth | 12 in. |
| Drying - | Time | 15 min. |
| 2nd layer | Temperature | 400 degrees F. |
| | Draft rate | 130 SCFM/FT$^2$ |
| | Depth | 12 in. |
| Drying - | Time | 15 min. |
| 3rd layer | Temperature | 400 degrees F. |
| | Draft rate | 130 SCFM/FT$^2$ |
| Retorting - | Time | 45 min. |
| downdraft | Temperature (hood) | 1150 degrees F. |
| | Draft rate | 60 SCFM/FT$^2$ |
| Gasification Techniques | | |
| (a) Method | | Circular grate steam-air injection |
| (b) Gasification cycle (downdraft) | | |
| Time | | 40 min. |
| Temperature (steam-air mixture) | | 160 degrees F. |
| Draft rate | | 50 SCFM/FT$^2$ |
| Cooling Techniques (updraft) | | |
| Time | | 20 min. |
| Temperature | | 200 degrees F. |
| Draft rate | | 60 SCFM/FT$^2$ |

TABLE II

PRODUCT ANALYSES

| | Green Pellet Blend | Re torted Pellets | Total Gasi-fied Product | −8" + 2" Clinker in Gasi-fied Product | −2" × 0 Pellets For recycle in Gasified Product |
|---|---|---|---|---|---|
| VM | 29.48 | 13.00 | 1.99 | 1.26 | 2.68 |
| FC | 30.99 | 36.49 | 22.40 | 15.31 | 29.52 |
| A | 39.53 | 50.51 | 75.61 | 83.43 | 67.80 |
| $C_f$ | 31.88 | 34.54 | 22.78 | 16.00 | 29.56 |
| Wt % solids | 100.00 | 78.26 | 52.28 | 26.14 | 26.14 |
| C units | | | | | |
| in solids | 31.88 | 27.03 | 11.91 | 4.18 | 7.73 |
| in gases | — | 4.85 | 15.12 | 5.30 | 9.82 |
| Percent of original C | | | | | |

TABLE II-continued

| | PRODUCT ANALYSES | | | | |
|---|---|---|---|---|---|
| | Green Pellet Blend | Re torted Pellets | Total Gasi-fied Product | −8" + 2" Clinker in Gasi-fied Product | −2" × 0 Pellets For recycle in Gasified Product |
| in solids 100.00 | | 84.79 | 37.36 | 13.11 | 24.25 |
| in gases | — | 15.21 | 47.43 | 16.62 | 30.81 |

From Table II, it may be noted that 84.79% of the original carbon in shale is residual after retorting, and this is diminished to 37.36% after sequentially gasifying the retorted shale. However, the clinkered portion of the shale only contains 13.11% of the original carbon. This represents a marked conversion and recovery of the fuel. This is realized when the −2-inch material as unconsolidated product is recycled, since it contains 24.25% of the original carbon.

What is claimed is:

1. A method of educting oil from high-carbon oil shales, comprising the steps of providing a burden of oil-bearing shale having a relatively high, fixed carbon content, charging the shale in a traveling grate machine to form a burden, moving the burden in a horizontal plane into a retorting zone, heating said burden in the retorting zone to an oil-educting temperature of at least 800 degrees F., condensing and removing oil educted from the burden, moving the burden to a gasifying zone, heating said burden in the gasifying zone in the presence of an oxygen-containing gas also containing between about 5% to about 15% water to raise the burden to a temperature which will convert substantial amounts of residual carbon in the burden to carbonaceous gases and which will promote substantial agglomeration or clinkering of the spent shale to enable a separation-recycling process, cooling the spent shale, and discharging coarse clinkered shale from the machine.

2. A method of educting oil according to claim 1, wherein said burden comprises a hearth layer of rubble-structured recycle materials, an intermediate layer of pelletized oil shale, and a top layer of particulate oil shale.

3. A method of educting oil according to claim 1, wherein said burden comprises a hearth layer rubble-structured recycle material, an intermediate layer of pelletized oil shale, and a top layer of rubble-structured recycle material.

4. A method of educting oil according to claim 2, wherein said rubble-structured recycle material is recycled from the discharge of said machine.

5. A method of educting oil according to claim 3, wherein said rubble-structured recycle material is recycled from the discharge of said machine.

6. A method of educting oil according to claim 4, wherein said rubble-structured recycle material has a particle size of about −2 inch+¼ inch.

7. A method of educting oil according to claim 5, wherein said rubble-structured recycle material has a particle size of about −2 inch+¼ inch.

8. A method of educting oil according to claim 2, wherein said particulate oil shale has a particle size of about −2 inch+¼ inch.

9. A method of educting oil according to claim 1, wherein the temperature of the burden in the gasifying zone is in excess of 1800 degrees F.

10. A method of educting oil according to claim 1, wherein the temperature of the burden in the gasifying zone is about 2300 degrees F.

11. A method of educting oil from fine, high-carbon oil shales, comprising the steps of providing a burden of oil-bearing shale having a relatively high, fixed carbon content, charging the shale in a traveling grate machine by (a) providing a hearth layer of rubble-structured recycle material, (b) layering a first charge of pelletized shale on said hearth layer, (c) layering a first covering charge of rubble-structured recycle material on said first charge while drying said first charge of pellets, (d) layering a second charge of pelletized shale on said covering charge, (e) layering a second covering charge of rubble-structured recycle material on said second charge while drying said first and second charges of pelletized shale, (f) layering a third charge of pelletized shale on said second covering charge, and (g) layering a charge of particulate oil shale on said third charge of pelletized shale, moving the burden in a horizontal plane into a retorting zone, heating said burden in the retorting zone to an oil-educting temperature of at least 800 degrees F., condensing and removing oil educted from the burden, moving the burden to a gasifying zone, heating said burden in the gasifying zone in the presence of an oxygen-containing gas also containing between about 5% to about 15% water to raise the temperature of the burden to a temperature which will convert substantial amounts of residual carbon in the burden to carbonaceous gases and which will promote substantial agglomeration or clinkering of the shale to enable a separation-recycling process, cooling the spent shale, and discharging the spent, coarse clinkered shale from the machine.

12. A method of educting oil according to claim 11, wherein said rubble-structured recycle material is recycled from the discharge of said machine.

13. A method of educting oil according to claim 12, wherein said rubble-structured recycle material has a particle size of about −2 inch+¼ inch.

14. A method of educting oil according to claim 11, wherein said particulate oil shale has a particle size of about −2 inch+¼ inch.

15. A method of educting oil according to claim 11, wherein the temperature of the burden in the gasifying zone is in excess of 1800 degrees F.

16. A method of educting oil according to claim 11, wherein the temperature of the burden in the gasifying zone is about 2300 degrees F.

* * * * *